United States Patent [19]

Henderson

[11] Patent Number: 4,907,706

[45] Date of Patent: Mar. 13, 1990

[54] STORAGE AND HANDLING SYSTEM

[76] Inventor: Joseph Henderson, 2211 E. Curry St., Long Beach, Calif. 90805

[21] Appl. No.: 247,671

[22] Filed: Sep. 22, 1988

[51] Int. Cl.[4] ..... A47F 7/16

[52] U.S. Cl. ..... 211/46; 211/94; 211/113; 211/162

[58] Field of Search ..... 211/46, 162, 94, 113; 40/617, 603, 604

[56] References Cited

U.S. PATENT DOCUMENTS

| | | | |
|---|---|---|---|
| 2,061,156 | 11/1936 | Humphrey | 211/162 X |
| 2,851,167 | 9/1958 | Rosenberg | 211/46 |
| 2,960,940 | 11/1960 | Schreyer | 211/162 X |
| 2,975,949 | 3/1961 | Lutsky | 211/94 X |
| 3,214,030 | 10/1965 | Graham et al. | 211/162 X |
| 3,254,437 | 7/1966 | Kursh | 40/617 X |
| 3,570,678 | 3/1971 | Lundberg | 211/46 |
| 3,717,258 | 2/1973 | McKinnon | 211/94 X |
| 3,913,995 | 10/1975 | Malcik et al. | 211/46 X |
| 3,978,988 | 9/1976 | Friedeberg | 211/113 |
| 4,300,692 | 11/1981 | Moreno | 211/94 X |
| 4,327,835 | 5/1982 | Leger | 211/46 X |
| 4,685,573 | 8/1987 | Ovitz, III | 211/162 X |
| 4,721,211 | 1/1988 | Lundberg | 211/46 |

*Primary Examiner*—Ramon S. Britts
*Assistant Examiner*—David G. Kolman
*Attorney, Agent, or Firm*—Plante, Strauss & Vanderburgh

[57] ABSTRACT

There is disclosed a storage and handling system for large flexible sheets such as printing plates. The system includes a rack which is of generally conventional construction having upright end standards or vertical posts that suspend at least one horizontal shelf. The shelf is provided with a plurality of horizontal tracks, each of which has a central, open channel along its bottom surface, to provide a slide receptacle. A T-bar is slidably and removably mounted in the open channel of each of these tracks. The T-bar has a plurality of apertures which are spaced, preferably at regular and predetermined distances, through its upright flange. These apertures receive removable two-ended hooks. The opposite ends of the hooks are inserted in apertures along one side edge of each of the printing plates. As the T-bar is completely removable from the rack, it also functions as a handling aid for the flexible printing plate, preventing the plate from bending or distorting and readily permitting a single operator to handle even the largest printing plates.

A small rack is also provided as an accesory, having at least one track for temporarily mounting on the front of the storage rack, to provide a sheet handling station.

8 Claims, 3 Drawing Sheets

STORAGE AND HANDLING SYSTEM

BACKGROUND OF THE INVENTION

1. Field of Invention

This invention relates to a storage and handling system for large flexible sheets and, in particular, to a system for the storage and handling of printing plates.

2. Brief Statement Of The Prior Art

Printing sheets are formed of thin sheet metal either magnesium or aluminum with a thickness typically of about 0.03 inch, and are relatively large in plainer dimensions, usually up to five or six feet long and two to five or six feet in width.

The storing and handling of these printing plates is troublesome. The printing plates are flexible and care must be taken to avoid sharp bends that would deface or destroy the plate. Commonly, the plates are hung or suspended by hooks which are placed in holes which are located usually at opposite corners along one side edge of the plate. The handling and storage of these plates is tedious and requires a high degree of care to avoid damage to the plate. With the large size plates, two persons are frequently required to handle and to hang these plates on various metal racks which have been provided for this purpose.

BRIEF STATEMENT OF THE INVENTION

This invention comprises a storage and handling system for large flexible sheets such as printing plates. The system includes a rack which is of generally conventional construction having upright end standards or vertical posts that suspend at least one horizontal shelf. The shelf is provided with a plurality of horizontal tracks, each of which has a central, open channel along its bottom surface, to provide a slide receptacle. A T-bar is removably mounted in the open channel of each of these tracks. The T-bar has a plurality of apertures which are spaced, preferably at regular and predetermined distances, through the upright flange of the T. These apertures receive removable two-ended hooks. The opposite ends of the hooks are inserted in apertures along one side edge of each of the printing plates. If desired, a plurality of hooks can be provided intermediate the length of the printing plate to provide additional support for the plate.

As the T-bar is completely removable from the rack, it also functions as a handling aid for the flexible printing plate, preventing the plate from bending or distorting and readily permitting a single operator to handle even the largest printing plates.

A handling accessory which is also provided comprises a small rack with at least one track which has brackets for temporarily mounting on the front of the storage rack, to provide a sheet handling station.

The sliding receipt of the T-bar support members in the open channel horizontal tracks of the rack also facilitates the storage of the printing plates. This permits the user to store a plurality of the printing plates in a side-by-side array in closely compact quarters since access to any of the printing plates can be readily obtained simply by slidably extending the T-bar support for the respective printing plate.

BRIEF DESCRIPTION OF THE DRAWINGS

The invention will be described with reference to the figures of which.

DESCRIPTION OF PREFERRED EMBODIMENT

Figure 1:
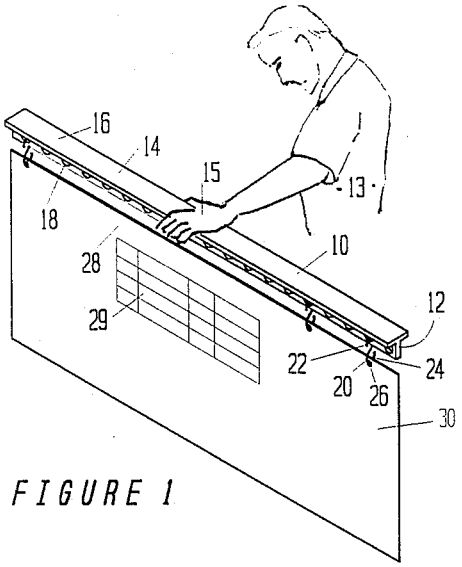
FIG. 1 illustrates the T-bar and its support of a printing plate useful for storage and handling of the plate.
Figure 2:
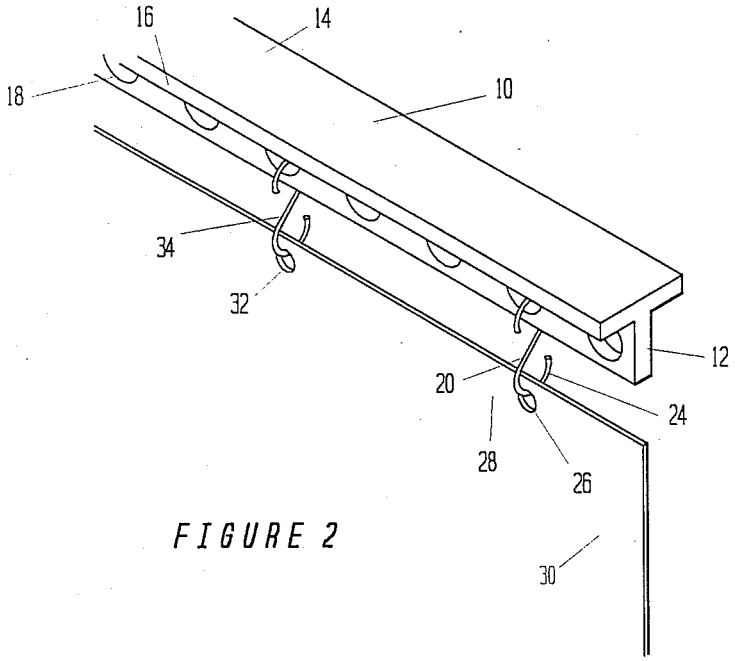
FIG. 2 is an enlarged view of the forward ends of the T-bar and printing plate shown in FIG. 1.

Referring now to FIGS. 1 and 2, the invention is disclosed as including a T-bar 10 which has a vertical flange 12 which is approximately 1 to 1.5 inches and which has horizontal side flanges 14 and 16 at its upper edge. The span covered by the horizontal side flanges is also approximately 1 to 1.5 inches. A plurality of apertures 18 is provided through the vertical flange 12. The apertures 18 are placed, preferably at regular spaced intervals along the length of the T-bar 10. In at least two of the apertures 18 are placed double-ended hooks 20 with their upper ends 22 received in apertures 18 which are located distally on the T-bar 10. The lower ends 24 of the double-ended hooks 20 are received in apertures 26 that are provided along one side edge 28 of the printing plate 30. At least two apertures 26 are distally located along one side edge of the printing plate. Preferably, and particularly for the longer printing plates which are more than about 3 feet long, one or more apertures 32 are also provided intermediate the length of the side edge 28 of the printing plate 30, and at least one additional hook 34 is placed through the aperture 32 and in an adjacent aperture 18 through the vertical flange 12 of T-bar 10 to support the printing plate at additional points along its length. The spacings of the apertures along the side edge 28 of the printing plate 30 is preferably in equal increments to the spacings between the apertures 18 which are located in the vertical flange of the T-bar 10, thereby providing ease in aligning or orienting the apertures of the printing plate 30 to the plurality of apertures 18 in the vertical flange of the T-bar.

The printing plate 30 is a conventional printing plate that is formed of aluminum or magnesium sheet metal having a thickness from about 0.01 to about 0.08 inch. Most typically the thickness is 0.025 to 0.035 inch. The printing plate 30 carries embossed or engraved off-set lettering and graphics 29 for the transfer of ink in a lithographic process, all in the conventional manner. The printing plates as thus described are fairly delicate members and any mishandling can cause the sheet to kink or fold, resulting in a fold line in the plate destroying it for subsequent use. Consequently, a great deal of care must be taken in handling and storing of these plates.

FIG. 1 illustrates the convenience of handling which is provided by the invention. The handler 13 can simply grasp the T-bar 10 with one hand 15 and the T-bar provides protection and rigidity to the plate 30, preventing its damage while transporting the plate from its storage location to the press.

Figure 3:
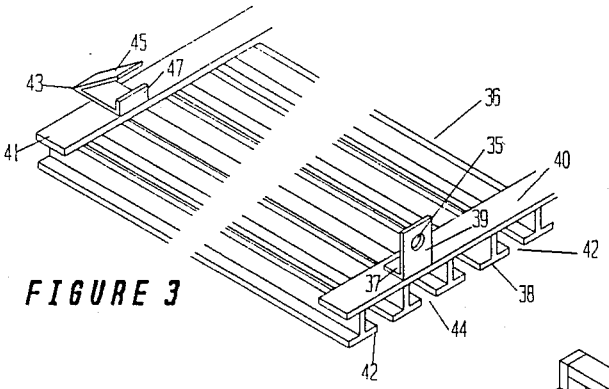
FIG. 3 illustrates an end of a storage shelf used in the invention.

Referring now to FIG. 3, the shelf 36 which is useful for storing of the printing plates 30 will be described. As there illustrated, the shelf 36 has a plurality of transverse track members, in the form of inverted T-bars 38 which are supported at their opposite ends by rails 40 and 41 that are secured to a support rack, described below. The inverted T-bars are assembled to the rails 40 and 41 by welding and the like and are spaced apart to define a continuous channel between these adjacent T-bars. Each inverted T-bar 38 thus forms a part of a slide track 42 which has a continuous, open slot 44 along its bottom surface. The shelf has at least two attachment brackets 37 on its front rail 40. Each bracket 37 is an angle bracket with an upright leg 39 having a central aperture to receive a conventional fastener for securing the shelf to a support member of the storage rack. The shelf also has at least two attachment brackets 43 on its rear rail 41. These brackets have an inclined leg 45 and a short, upright leg 47. These brackets 43 are intended to clamp on the bottom web of a conventional channel usually found on storage racks.

Figure 4:
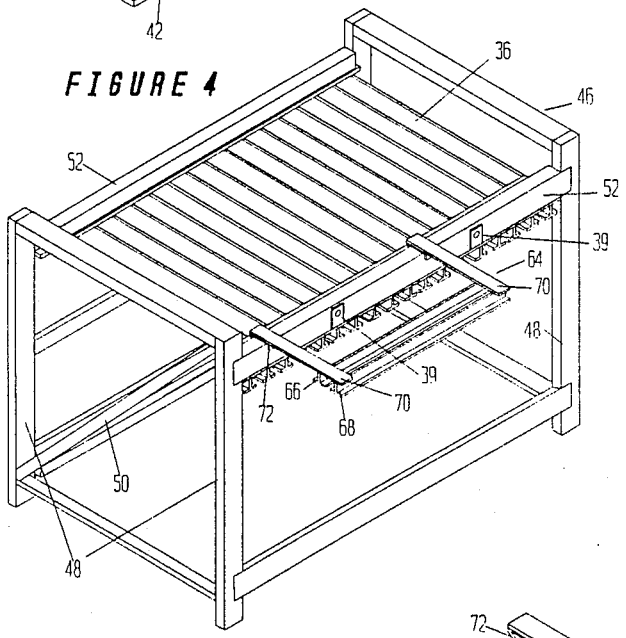
FIG. 4 illustrates a storage rack which supports the storage shelf shown in FIG. 3 with the sheet plate handling station accessory.

Referring now to FIG. 4, the shelf 36 is supported by a rack 46 which has a pair of vertical standards 48 at its opposite ends and these standards have various diagonal bracing 50 for rigidity. At least a pair of longitudinal side rails 52 are provided extending the length of the rack. The rails are conventional U-shaped channels, with the open face directed to the rear of the rack. A pair of such side rails is provided at each of the horizontal shelf levels to be used with this rack. At least one level and preferably at least two horizontal shelf levels can be provided. The rear attachment brackets 43 clamp onto the lower web of the channel 52, and the upright legs 39 of the front brackets are fastened to the front channel 52 with bolts, or other fasteners.

Also shown in FIG. 4 is the sheet plate handling accessory 71 which provides a plate handling station at the front of the storage rack 46. The accessory 71 has a pair of inverted T-bars 66 and 68 which are distally secured to a pair of arms 70. The open space between the T-bars forms a track 44 to receive a T-bar such as 10, shown in FIG. 1, to support a sheet plate longitudinally along the front of the rack 46. The handling accessory 71 has attachment brackets 72 at each of the ends of the arms 70. These brackets are similar to brackets 43 shown in FIG. 3 and hook over the top web of the front channel 52, thereby supporting the accessory. Since this accessory is thus mounted at an elevation above the transverse tracks 44 of the storage shelf 36, the accessory can be left on the front of the storage rack 46 without interfering with accessibility to the printing plates stored in the rack 46. At any time, the user can place a T-bar 10 in the track 44 of the accessory 71 to hold the bar temporarily while loading or transferring plates to the bar 10.

Figure 5:
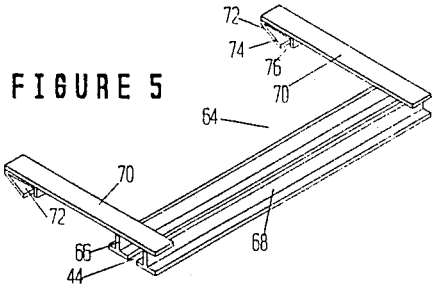
FIG. 5 is an enlarged view of the sheet plate handling accessory.

The accessory 71 is shown in an enlarged view in FIG. 5, removed from the storage rack 46. As there illustrated, the support brackets 72 are formed with an inclined leg 74 and a short vertical leg 76 to provide a removable clamp to attach to the web of a channel rail such as 52.

Figure 6:
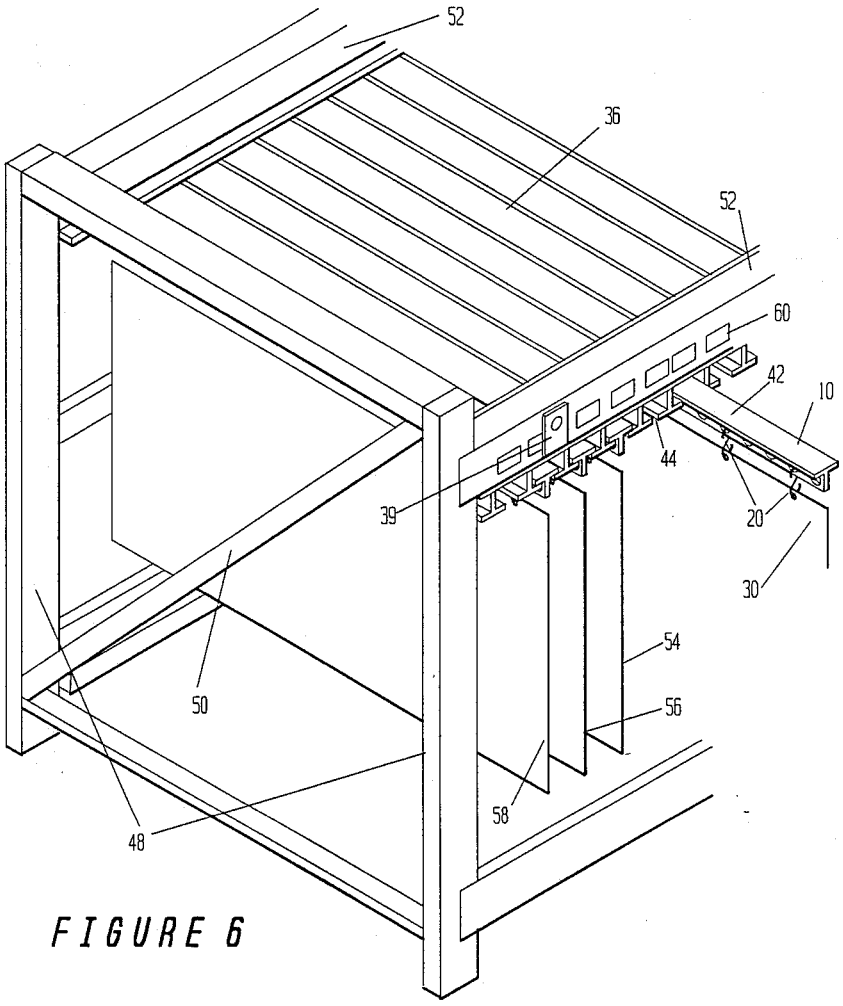
FIG. 6 is an enlarged view of a portion of the storage rack and shelf of FIG. 4 with stored printing plates.

Referring now to FIG. 6, the invention is illustrated with printing plates in stored positions. The accessory 71 has been removed for illustration purposes. In this application, each printing plate 30 is suspended on a T-bar 10 with a plurality of double-ended hooks 20. The attachment of the T-bar 10 to the printing plate 30 will usually be made at the printing station when the printing plate is removed from the printing press. This permits a single operator to transport even large printing plates without risking damage by creasing or folding of the plate. The operator stores the printing plate simply by inserting one end of the T-bar 10 within the horizontal slide track 42 so that the vertical flange 12 of the T-bar 10 protrudes downwardly through the open channel 44 along the length of the track 42. The operator then pushes the T-bar 10 and its supported printing plate 30 into the horizontal track to move the printing plate 10 into a parallel spaced-apart relationship to the various printing plates such as 54, 56 and 58 which are stored on the shelf 36 of the storage rack 46. The rack 46 can contain various identifying indica 60 placed along its longitudinal side rail 52 to identify the particular printing plate that is stored in each of the tracks with that horizontal track, thereby permitting fast access or identification of the printing plates which are stored in the rack.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims.

What is claimed is:

1. A storage and handling system for large, flexible sheets such as printing plates which comprises:

a. a rack having upright standards and at least one horizontal shelf support formed by first and second longitudinal rails, formed of U-shaped channel members having a vertical web and coextensive upper and lower horizontal webs, which are attached at their opposite ends to said upright standards;

b. a shelf comprising a pair of spaced apart and parallel first and second shelf rails, and spanning therebetween a plurality of horizontal support members disposed parallel to each other and at regular and spaced intervals and thereby defining along each of said spaced intervals, a plurality of horizontal tracks with open channels along their bottom surfaces and distally supported from and permanently secured to said first and second shelf rails, and including a first set of attachment brackets carried on said first shelf rail to secure it to the first of said shelf support rails of said rack and a second set of attachment brackets carried on said second shelf support rail, each of said second set attachment brackets having a base leg and an upwardly and inwardly inclined leg at one end thereof and a vertical leg at the opposite end thereof and disposed to receive said lower horizontal web of said second shelf rail between said inclined and base legs, whereby to secure it to the second of said shelf support rails of said rack;

c. a like plurality of tee bars having a vertical web and symmetric horizontal side flanges, each mounted with its vertical web slidably and removably received within a respective open channel of a horizontal track and with its side flanges resting on the bottom surface of its respective track;

d. a plurality of apertures at spaced apart locations through the vertical web of each of said tee bars;

e. a plurality of double ended hooks with their upper hook ends received in selected ones of said plurality of apertures;

f. a plurality of flexible sheets having a second plurality of apertures at selected positions adjacent one side edge thereof; and g. the lower hook ends of said hooks received in selected ones of said second plurality of apertures, whereby each of said flexible sheets is supported at opposite corners along its said side edge by a respective tee bar, and each tee bar is removably and slidably mounted in a respective horizontal track of said shelf.

2. The system of claim 1 wherein said sheets have a thickness from 0.01 to about 0.05 inch.

3. The system of claim 1 wherein said flexible sheets are metal printing plates.

4. The system of claim 1 wherein said flexible sheets have lengths from 2 to about 6 feet and widths from 3 to about 8 feet.

5. The system of claim 1 wherein said second plurality of apertures includes at least one aperture located intermediate the length of said edge of each of said sheets.

6. The system of claim 1 wherein said first plurality of apertures are spaced at equal distances along the entire length of each of said tee bars.

7. The system of claim 1 wherein said each of said first set of attachment brackets has a vertical leg for attachment tot he vertical web of its respective channel member.

8. A storage and handling system for large, flexible sheets such as printing plates which comprises:

a. a storage rack having upright standards and at least one horizontal shelf formed by a pair of longitudinal comprising U-shaped channel members having a vertical web and coextensive, upper and lower horizontal webs rails which are attached at their opposite ends to said upright standards;

b. a plurality of horizontal support members supported from said longitudinal rails at said horizontal shelf and defining a plurality of horizontal tracks with open channels along their bottom surfaces;

c. a like plurality of tee bars having a vertical web and symmetric horizontal side flanges, each mounted with its vertical web slidably and removably received within a respective open channel of a horizontal track and with its side flanges resting on the bottom surface of its respective track;

d. a plurality of apertures at spaced apart locations through the vertical web of each of said tee bars;

e. a plurality of double ended hooks with their upper hook ends received in selected ones of said plurality of apertures;

f. a plurality of flexible sheets having a second plurality of apertures at selected positions adjacent one side edge thereof; and g. the lower hook ends of said hooks received in selected ones of said second plurality of apertures, whereby each of said flexible sheets is supported at opposite corners along its said side edge by a respective tee bar, and each tee bar is removably and slidably mounted in a respective horizontal track of said shelf; and h. a plate transfer station comprising an accessory rack disposed perpendicularly to, and exteriorly of, said storage rack, and having at least two, inverted tee bars distally and permanently attached to a pair of parallel arms, each of said arms supporting, at their ends opposite the ends attached to said tee bars, attachment brackets, each including a downwardly and forwardly inclined leg and an adjacent vertical leg adapted to hook over an upper horizontal web of a respective channel member of said rack.

* * * * *